US005326091A

United States Patent [19]

Giacometto et al.

[11] Patent Number: 5,326,091

[45] Date of Patent: Jul. 5, 1994

[54] PHOTOCOPYING MACHINE WITH AN AUXILIARY SHEET FEEDER

[75] Inventors: Felice Giacometto, Caluso; Andrea Perino, Cuorgné; Francesco Beltramo, San Giusto Canavese, all of Italy

[73] Assignee: Olivetti-Canon Industriale S.p.A., Ivrea, Italy

[21] Appl. No.: 994,965

[22] Filed: Dec. 23, 1992

[30] Foreign Application Priority Data

Jan. 13, 1992 [IT] Italy ..... T092 A 000017

[51] Int. Cl.[5] ..... B65H 5/00

[52] U.S. Cl. ..... 271/10; 271/124; 271/127; 271/162; 271/167; 271/274; 271/9

[58] Field of Search ..... 271/10, 121, 124, 126, 271/127, I162, 167, 248, 250, 273, 274

[56] References Cited

U.S. PATENT DOCUMENTS 5,002,266 3/1991 Kikuchi et al. ..... 271/9 X 5,127,644 7/1992 Yoshihiro et al. ..... 271/121 X

FOREIGN PATENT DOCUMENTS

| | | | |
|---|---|---|---|
| 0040334 | 3/1985 | Japan | 271/162 |
| 0258030 | 12/1985 | Japan | 271/273 |
| 0229765 | 10/1986 | Japan | 271/273 |
| 0027249 | 2/1987 | Japan | 271/273 |
| 0071038 | 3/1988 | Japan | 271/167 |
| 0074842 | 4/1988 | Japan | 271/167 |
| 0127333 | 5/1990 | Japan | 271/121 |
| 0163223 | 6/1990 | Japan | 271/162 |

*Primary Examiner*—H. Grant Skaggs
*Assistant Examiner*—Carol Lynn Diuzbick
*Attorney, Agent, or Firm*—Banner, Birch, McKie & Beckett

[57] ABSTRACT

Improvements relate to a photocopying machine with an auxiliary sheet feeder including a sheet-separation unit which withdraws sheets disposed on a tray. The improvements enable better separation of the sheets and easier removal of jammed sheets. (FIG. 1).

10 Claims, 5 Drawing Sheets

PHOTOCOPYING MACHINE WITH AN AUXILIARY SHEET FEEDER

DESCRIPTION

The present invention relates to a photocopying machine with an auxiliary sheet feeder.

A photocopying machine normally has a main sheet feeder which feeds the sheets to be printed along an entrainment path for the sheets which passes through two pairs of register rollers, a region in which the sheets are printed, a fixing region and a delivery region. Normally, the photocopier also has an auxiliary sheet feeder, also known as a by-pass feeder, which enables the machine to be supplied with sheets of different sizes or substances from those supplied by the main feeder.

The object of the present invention is, in general, to effect improvements to the auxiliary feeder. In particular, an object of the present invention is to improve the grip and the entrainment of the sheets by the sheet-separation unit of the auxiliary feeder. Another object of the present invention is to enable quicker and easier removal of any sheets jammed in the register rollers of the machine or in the sheet-separation unit of the auxiliary feeder.

According to the present invention, these and other objects are achieved by means of a photocopying machine having the characteristics listed in the main claim.

Figure 1:
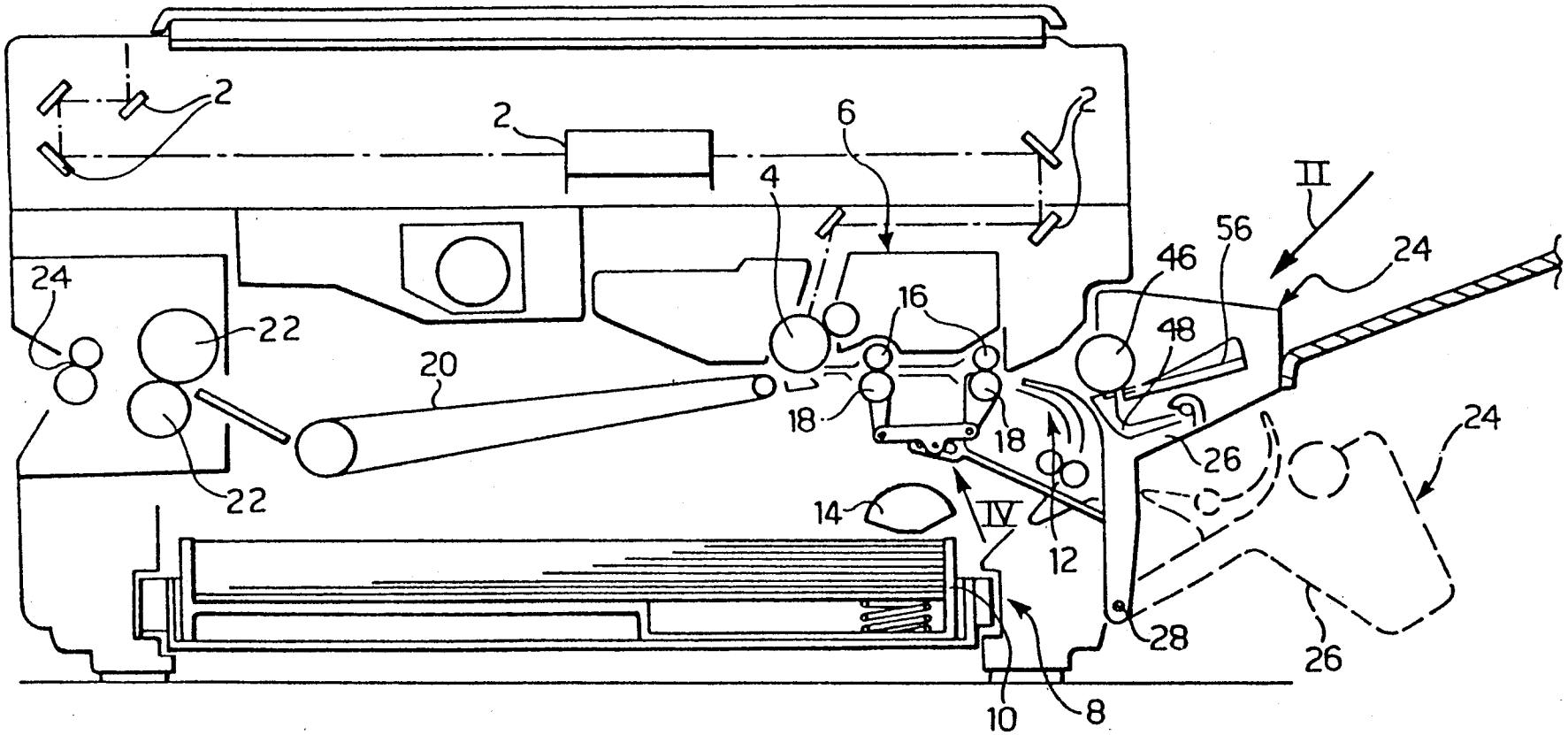
Figure 2:
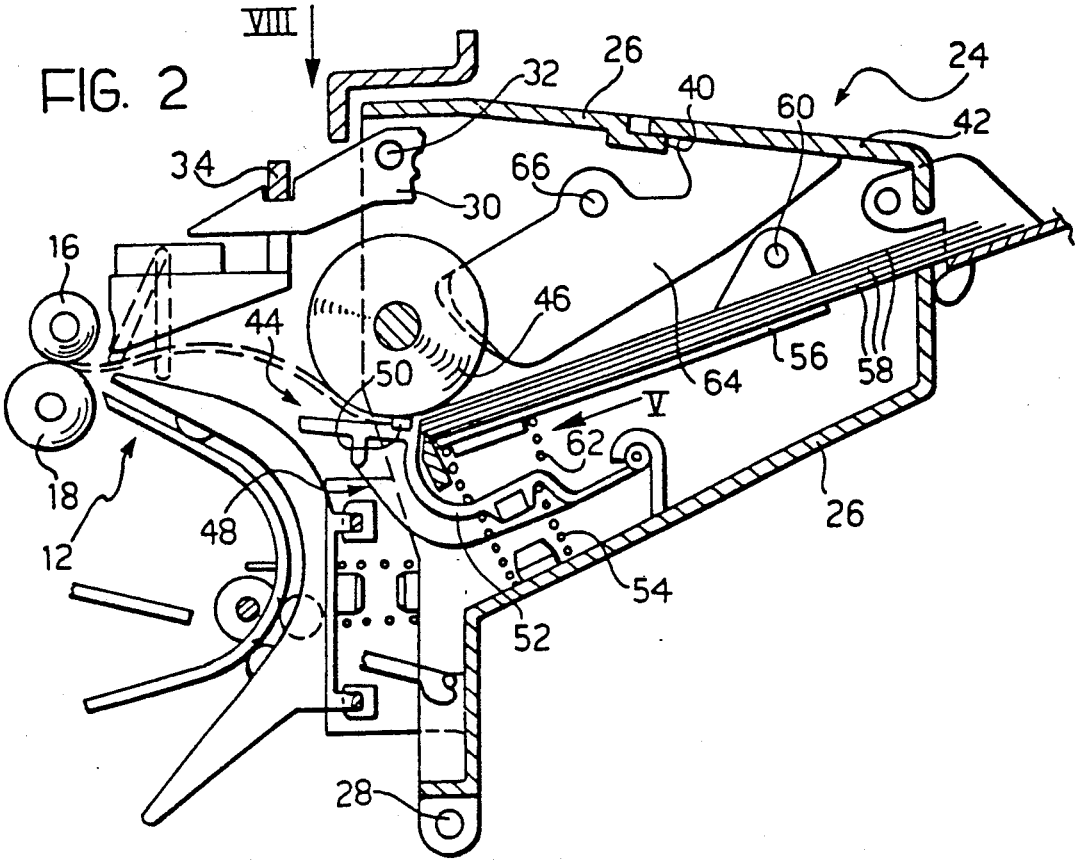
Figure 3:
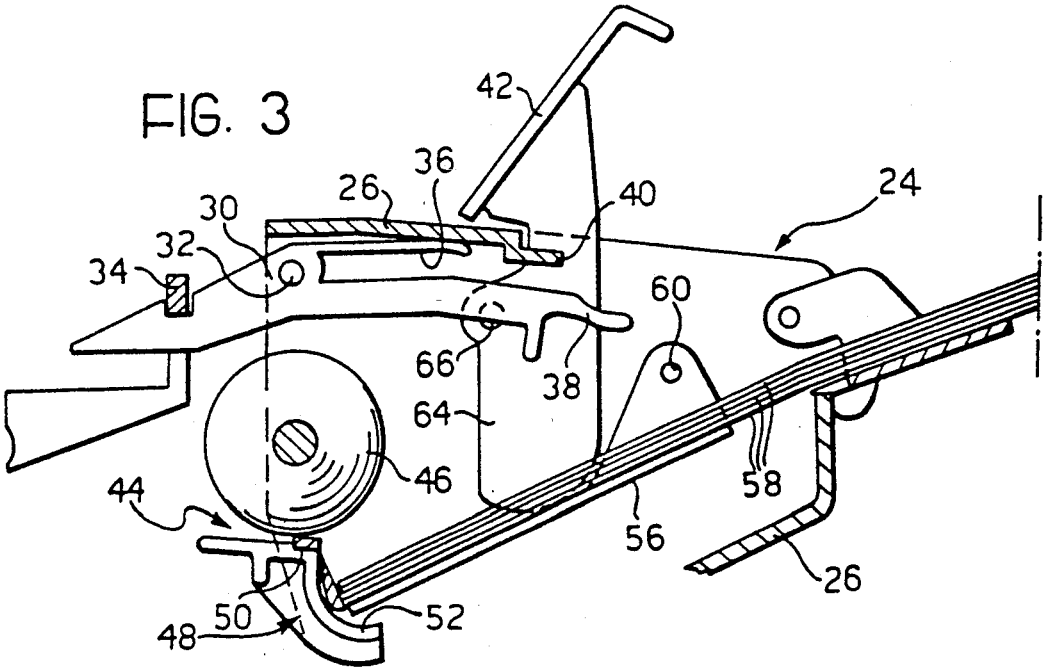

Further characteristics and advantages of the present invention will become clear in the course of the detailed description which follows with, reference to the appended drawings, provided purely by way of non-limiting example, in which:

FIG. 1 is a schematic, longitudinal section of a machine according to the present invention, FIG. 2 is a section of the portion indicated by the arrow II in FIG. 1, on an enlarged scale, FIG. 3 is a partial section similar to that of FIG. 2, showing the portion indicated by the arrow II in FIG. 1 in a different configuration, .

Figure 4:
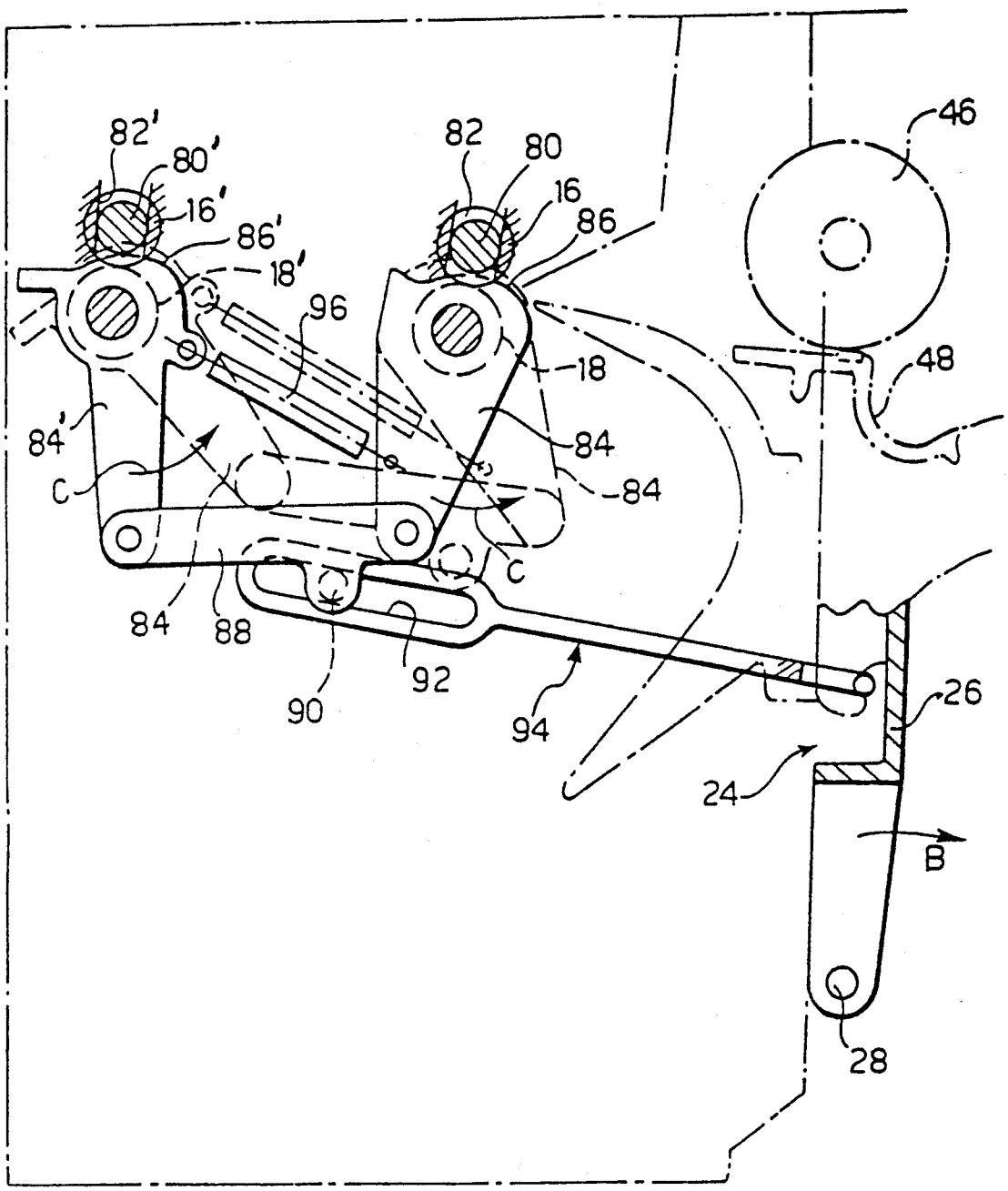
Figure 6:
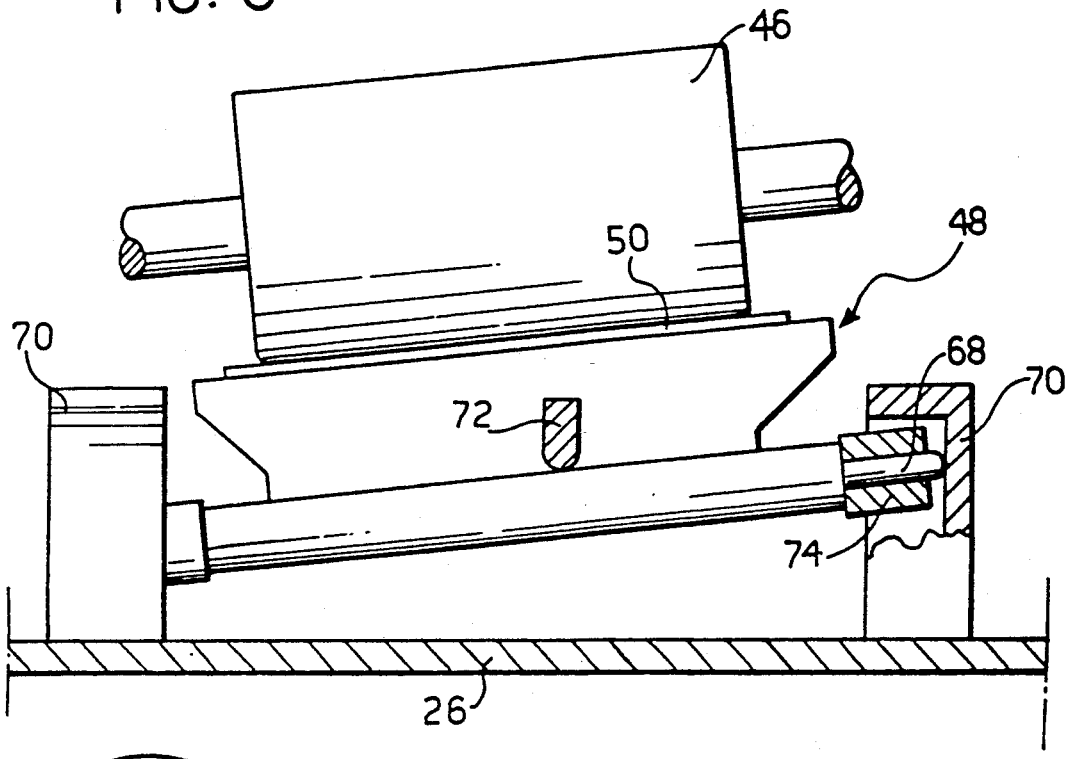
Figure 5:
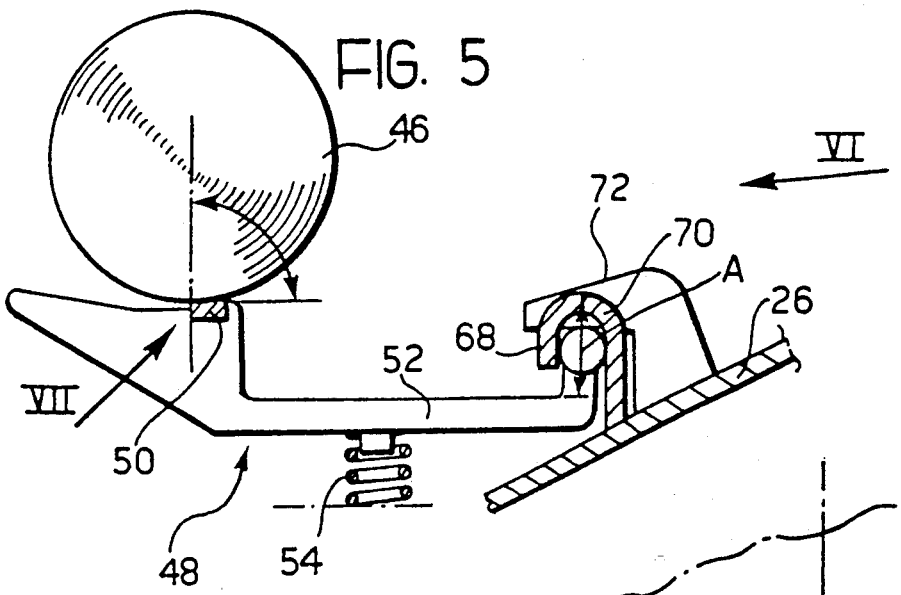
Figure 7:
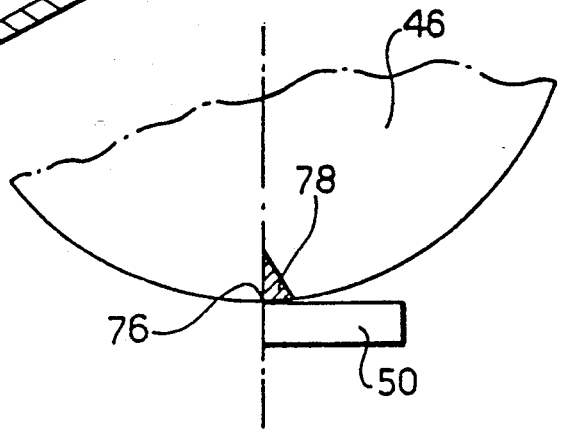
Figure 8:
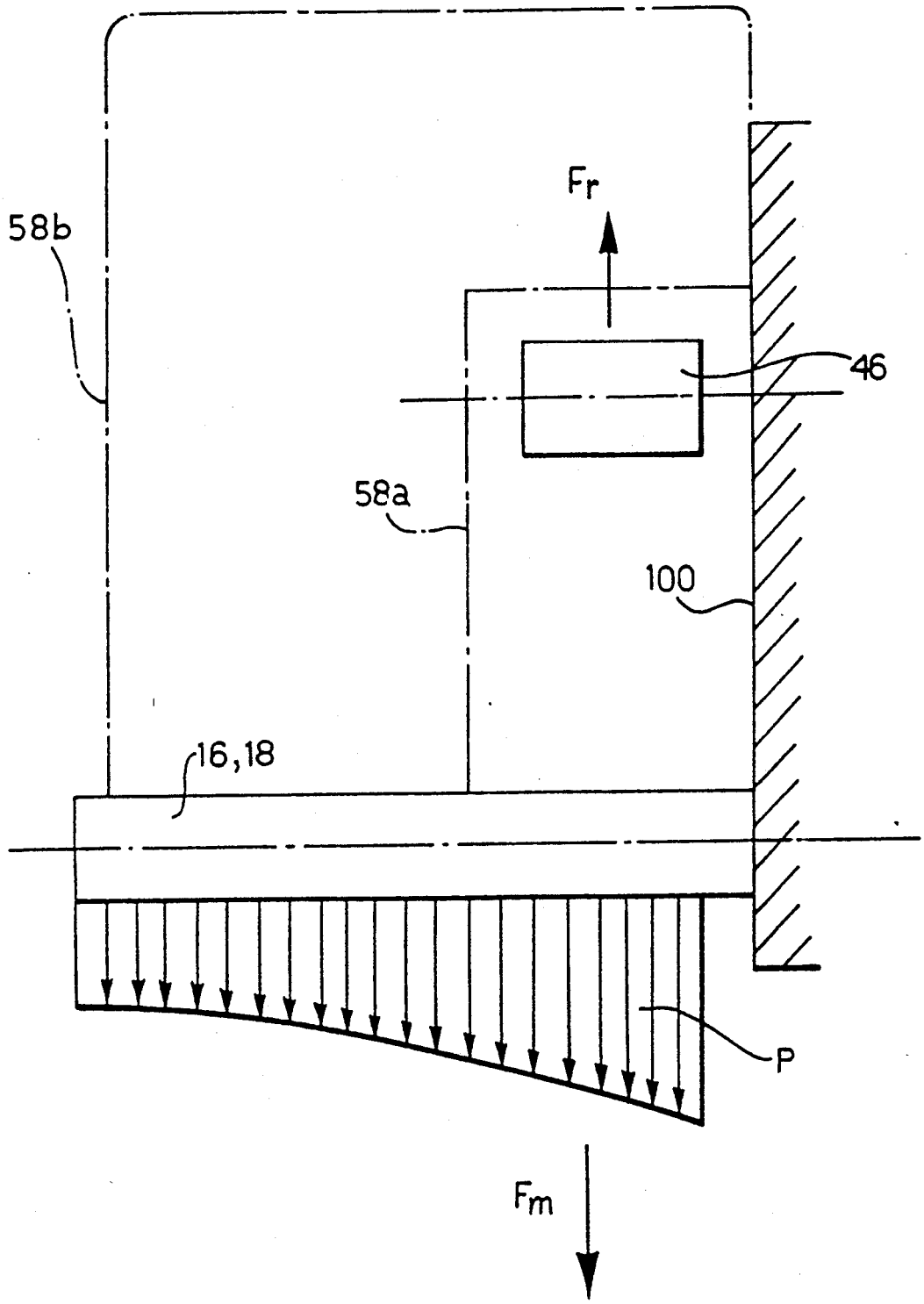

FIG. 4 is a schematic view of the portion indicated by the arrow IV in FIG. 1, on an enlarged scale, FIG. 5 is a schematic view of the portion indicated by the arrow V in FIG. 2, FIG. 6 is a view taken on the arrow VI of FIG. 5, on an enlarged scale, FIG. 7 shows the detail indicated by the arrow VII in FIG. 5, on an enlarged scale, and FIG. 8 is a schematic plan view taken on the arrow VIII of FIG. 2.

With reference to FIG. 1, a photocopying machine indicated 1, includes, in known manner, an optical chain 2 which transmits the images to be reproduced onto the surface of a photoconductive drum 4. The photoconductive drum 4 forms part of a printing region 6 which is not described in detail since it is of known type and falls outside the scope of the present invention.

A main feeder 8 includes a cassette 10 containing the sheets to be printed which are sent along an entrainment path 12 by a main sheet-separating roller 14. Two pairs of contrarotating register rollers 16, 18 and 16', 18' with parallel axes are disposed upstream of the printing region 6 in the entrainment path 12, in known manner.

Again in known manner, the sheets which emerge from the printing region 6 are conveyed by a belt 20 between two fixing rollers 22 from there the printed sheets are sent to a delivery region 23.

An auxiliary sheet feeder is indicated 24. Sheets of sizes and substances different from those in the cassette 10 of the main feeder 8 can be fed by the feeder 24 to the register rollers 16, 18 and 16', 18' and from there to the printing region 6.

As can be seen in greater detail in FIGS. 2 and 3, the auxiliary feeder 24 includes a casing 26 which is pivoted on the body of the machine 1 about an axis 28. The feeder 24 is therefore movable about the axis 28 between a raised, operative position, shown in continuous outline in FIG. 1, and a lowered, inoperative position, shown in broken outline in the same drawing. The feeder 24 has a closure hook 30 which is pivoted on the casing 26 by means of a pin 32 and cooperates with a restraining portion 34 carried by the body of the machine 1. The hook 30 has a resilient tongue 36 which keeps the hook 30 in a position of engagement with the portion 34. The hook 30 is shaped like a rocker arm and has a manually-operable release handle 38. The release handle is accessible through a hole 40 closed by a cover 42. The fact that the handle 38 can be operated only after the cover 42 has been opened constitutes a safeguard against the accidental release of the device 24.

Within the casing 26 is a sheet-separation unit 44 formed by a sheet-separating roller 46 which cooperates with a pad 48. The pad 48 is constituted by a strip of soft rubber 50 carried by an arm 52 which is pivoted on the casing 26 in the manner which will be explained below. The pad 48 is urged against the cylindrical surface of the sheet-separating roller 46 by a helical compression spring 54 interposed between the arm 52 and the casing 26.

A tray which supports the auxiliary sheets is indicated 56. The tray 56 is pivoted on the casing 26 about an axis 60 and is urged upwardly by a helical spring 62 interposed between the tray 56 and the arm 52 of the pad 48.

The cover 42 is fixed to a pair of arms 64 (only one of which is visible in FIGS. 2 and 3) which are pivoted on the casing 26 about an axis 66. The arms 64 are intended to urge the tray 56 downwardly against the action of the springs 54, 62 as a result of the lifting of the cover 42 (see FIG. 3) . When the cover 42 is raised in order to remove the auxiliary sheets 58 or to add new ones, the sheets 58 are thus prevented from being pinched between the sheet-separating roller 46 and the pad 48. During the raising of the cover 42, the arms 64 compress both the spring 62 and the spring 54, since these two springs are connected in series, and the strip 50 of the pad 48 is thus moved slightly away from the cylindrical surface of the sheet-separating roller 46 so as to prevent one or more sheets 58 from being caught in the sheet-separation unit 44 when the cover 42 is opened.

As can be seen in greater detail in FIGS. 5 and 6, the arm 52 of the pad 48 is hinged to the casing 26 by means of a pair of pins 68 which engage respective supports 70 carried by the casing 26. Each support 70 has an inverted-U-shaped profile so that the respective pin 68 can move freely in the directions indicated by the double arrow A in FIG. 5. The arm 52 of the pad 48 is urged, by the action of the spring 54, against a bearing element 72 intermediate the two supports 70. This arrangement means that the pad 48 can pivot about an axis perpendicular to the plane of FIG. 6 to compensate for any unevenness in the thickness of the sheet of paper in direction of its width. This solution also compensates for any defects of parallelism between the axis of the sheet-separating roller 46 and the casing 26. This defect has been exaggerated in FIG. 6 for simplicity of representation.

A soft rubber bush, 74 fitted on each, pin 68 (see FIG. 6) is fitted with, moderate force in the U-shaped seat of the respective support 70. The bush 74 dampens the vibrations of the pad 48 caused by the passage of particularly stiff sheets such as, for example, transparent plastics sheets.

The fact that the supports 70 are open downwardly simplifies the removal and fitting of the pad during maintenance operations.

According to another characteristic of the present invention, the cross-section of the strip 50 of the pad 48 in a plane perpendicular to the axis of the sheet-separating roller 46 has a corner 76 (see FIG. 7 in particular) at the point at which the strip 50 is tangential to the cylindrical surface of the roller 46. This means that the contact pressure between the strip 50 and the roller 46 is at its maximum at the tangent point; in FIG. 7, the contact-pressure curve, indicated 78, is approximately linear with a maximum in correspondence with the corner 76. Experimental tests have shown that a pressure peak at the tangent point between the roller 46 and the strip 50 improves the separation of the sheets and reduces the risk of their jamming, particularly in the case of transparent sheets.

FIG. 4 shows a further detail of the machine according to the present invention. Two pairs of register rollers, indicated 16, 18 and 16', 18' are situated on the entrainment path of the sheets, upstream of the printing region 6. As already stated above, the register rollers 16, 18 and 16', 18' receive the sheets to be printed, both those coming from the main feeder and those coming from the auxiliary feeder 24. The lower rollers 18, 18' are rotated by means of a gear train, not shown, and the upper rollers 16, 16' are urged resiliently against the surfaces of the respective lower rollers 18, 18'. The pins 80, 80' of the upper rollers 16 are slidable in respective guides 82, 82' arranged perpendicular to the axis of rotation of The rollers 16, 16'. A lever 84, 84' mounted rotatably on the axis of each of the lower rollers 18, 18' has a cam profile 86, 86' which cooperates with the pin 80, 80' of the respective movable roller 16, 16'. The two levers 84, 84' are interconnected by a connecting rod 88 which has a pin 90 slidable in a slot 92 in a tie rod 94 which is connected to the casing 26 of the auxiliary feeder 24. A biasing spring 96 interposed between the two levers 84, 84' keeps the levers 84, 84' in the position shown in continuous outline in FIG. 4. In this position, the cam profiles 86, 86' of the levers 84, 84' do not interfere with the pins 80, 80' of the rollers 16, 16' which are kept in contact with the cylindrical surfaces of the lower rollers 18, 18' by the loading of springs, not shown.

When the auxiliary feeder 24 is brought into its lowered position by being pivoted about the axis 28 in the sense indicated by the arrow B in FIG. 4, the tie rod 94 pivots the levers 84, 84' in the sense indicated by the arrows C in FIG. 4, by means of the connecting rod 28. In FIG. 4, the positions of the levers 84 corresponding to the lowered position of the auxiliary feeder 24 are shown in broken outline. In this configuration, the cam profiles 86, 86' of the levers 84, 84' urge the movable rollers 16, 16' upwardly so that they are moved away from the cylindrical surfaces of the lower rollers 18, 18'. When the auxiliary feeder, 24 is lowered, the register rollers 16, 18 and 16', 18' are thus moved apart automatically so as to simplify the removal of sheets jammed between the register rollers 16, 18 and 16', 18'.

FIG. 8 shows schematically the relative arrangement of the sheet-separating roller 46 and of the first pair of register rollers 16, 18. The sheet-separating roller 46 is narrower than the smallest sheet 58*a* which can be supplied by means of the auxiliary feeder 24. The width of the register rollers 16, 18 on the other hand is equal to or greater than that of the largest sheet 58*b* which can be supplied by the feeder 24. The edges of the sheets 58 bear against a fixed lateral locating guide 100. The sheet-separating roller 46 is disposed near the lateral guide 100 and is situated approximately on the centraline of the smallest sheets 58*a*. The sheet-separating roller 46 supplies the sheets 58 to the register rollers 16, 18 and the sheets 58' are then entrained by the rollers 16, 18 whilst the roller 47 rotates idly about its own axis. When the sheets 58 are entrained by the rollers 16, 18, the roller 46 exerts a resisting force Fr on the sheets 58. In the case of sheets wider than the smallest sheets 58*a*, the resisting force Fr tends to rotate the sheet about an axis perpendicular to the plane in FIG. 8 since the force is offset from the longitudinal centraline of the sheet.

In order to compensate for the effect of the eccentricity of the resisting force Fr, the register roller 16 is urged against the roller 18 by a contact pressure p which varies along the axes of the rollers 16, 18 so that the resultant, indicated Fm, of the pulling forces of the rollers 16, 18 is approximately aligned with the resisting force Fr of the sheet-separating roller 46. The variation of the contact pressure along the axes of the rollers 16, 18 may be achieved, for example, by means of springs of different stiffnesses acting against the ends of the movable roller 16. In order for the forces Fm and Fr to be aligned, the contact pressure p must increase towards the ends of the rollers 16, 18 which are nearest the lateral guide 100.

We claim:

1. A photocopying machine having a body with an auxiliary sheet feeder which includes a casing containing a tray for supporting the sheets to be supplied to the machine and a sheet-separation unit including a motor-driven sheet-separating roller cooperating with a pad, the sheet-separation unit being arranged to supply the sheets to at least one pair of contrarotating register rollers which are carried by the machine and are situated on an entrainment path both for the sheets coming from a main feeder and for sheets coming from the auxiliary feeder, wherein the improvement consists in that the casing is pivotable on the body of the machine and is movable between a raised, working position and a lowered, inoperative position, the casing having a closure hook for restraining the casing in said raised, working position, the hook being connected to a release handle which is situated within the casing and can be operated manually through an opening closed by a cover hinged to the casing.

2. A photocopying machine according to claim 1, wherein the tray is pivotable on the casing and is urged by resilient means towards a position in which the sheets situated thereon can be withdrawn by the sheet-separation unit, the cover having at least one arm which, as a result of the opening of the cover, cooperates with the tray to move the tray away from the sheet-separation unit against the action of the resilient means.

3. A photocopying machine according to claim 1, wherein the pad includes a strip of a soft material which is kept in contact with a cylindrical surface of the roller, the strip having a cross-section which, in a plane perpendicular to the axis of rotation of the roller, has a corner which is situated at a point at which the strip is tangential to the roller.

4. A photocopying machine according to any of the preceding claims, wherein said pad includes an arm which is hinged to the casing about an axis parallel to the axis of rotation of the roller by means of a pair of pins engaging respective supports with U-shaped profiles which are elongated in a direction perpendicular to the axes of the pins, the arm cooperating with a bearing element situated in a central position between the two supports.

5. A photocopying machine according to claim 4, wherein respective bushes of resilient material are interposed between the pins of the pad and the respective U-shaped supports and are fitted in the U-shaped supports with moderate force, to allow little adjustment movements of the pad against said roller.

6. A photocopying machine according to claim 1, wherein at least one of the register rollers is movable relative to the opposite roller in a direction perpendicular to the axis of rotation of the movable register roller, between a first position in which the cylindrical surfaces of the movable roller and the opposite roller are in contact with each other and a second position in which the cylindrical surfaces are spaced from each other, the movement of the movable roller being brought about by a lever connected to the casing of the auxiliary feeder so that the movable roller is moved from said first position to said second position as a result of the movement of the casing from said raised, working position to said lowered, inoperative position.

7. A photocopying machine according to claim 6, wherein the lever is connected to the casing by means of a tie-rod element having a slot portion which cooperates with the lever so that the register rollers are moved towards and away from each other only when the casing is in said raised, working position and in said lowered, inoperative position, respectively.

8. A photocopying machine according to claim 1, including first and second pairs of register rollers, wherein one roller of each pair is movable relative to the corresponding opposite roller in a radial direction between a first position in which the rollers of the pair are in mutual contact and a second position in which they are separated, the movement of each of the movable rollers being achieved by means of cams which are rotatable coaxially with the opposite rollers and which cooperate with the movable rollers, the cams being fixed to control levers which are interconnected by a connecting rod, the connecting rod in turn being connected to the casing of the auxiliary feeder so that the movable rollers are moved from said first positions to said second positions as a result of the movement of the casing from said raised, working position to said lowered, inoperative position.

9. A photocopying machine according to claim 8, wherein the connecting rod is connected to the casing by means of a tie-rod element having a slot portion which cooperates with the connecting rod so that the movable rollers are moved towards and away from the corresponding opposite rollers only when the casing is in said raised working position and in said lowered, inoperative position, respectively.

10. A photocopying machine according to claim 1, wherein the auxiliary feeder has a fixed lateral guide for locating edges of the sheets, the sheet-separating roller being situated adjacent the lateral guide and being narrower than the maximum width of the sheets which can be supplied by means of the auxiliary device, said at least one pair of register rollers being urged against one another by a contact pressure which is variable along the axes of the rollers and which increases towards ends of the rollers nearest the lateral guide, to compensate for a deviating effect produced by the sheet-separating roller on sheets larger than the sheets having the minimum size which can be processed by the machine.

* * * * *